US012590779B2

(12) United States Patent
Kartalov et al.

(10) Patent No.: US 12,590,779 B2
(45) Date of Patent: Mar. 31, 2026

(54) STEAD-FIELD COILGUN METHODS AND DEVICES

(71) Applicant: The United States of American, as represented by the Secretary of the Navy, Arlington, VA (US)

(72) Inventors: Emil Paskalev Kartalov, Pacific Grove, CA (US); Jeffrey Kyle Catterlin, Salinas (CA)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 126 days.

(21) Appl. No.: 18/733,666

(22) Filed: Jun. 4, 2024

(65) Prior Publication Data

US 2026/0036391 A1 Feb. 5, 2026

Related U.S. Application Data

(63) Continuation of application No. 18/732,083, filed on Jun. 3, 2024, now Pat. No. 12,498,195.

(60) Provisional application No. 63/470,757, filed on Jun. 2, 2023.

(51) Int. Cl.
*F41B 6/00* (2006.01)

(52) U.S. Cl.
CPC ..... *F41B 6/003* (2013.01)

(58) Field of Classification Search
CPC ..... F41B 6/003
USPC ..... 124/3
See application file for complete search history.

(56) References Cited

U.S. PATENT DOCUMENTS

| | | | | | |
|---|---|---|---|---|---|
| 4,694,729 | A * | 9/1987 | Hall | F41B 6/006 | 310/11 |
| 4,917,335 | A * | 4/1990 | Tidman | B64C 23/00 | 102/490 |
| 4,928,572 | A * | 5/1990 | Scott | F41B 6/006 | 318/135 |
| 5,375,504 | A * | 12/1994 | Bauer | F41B 6/006 | 89/8 |
| 9,581,409 | B2 * | 2/2017 | Post | F41B 6/003 | |
| 2009/0207555 | A1 * | 8/2009 | Hackenberger | C04B 35/493 | 29/25.42 |
| 2024/0401903 | A1 * | 12/2024 | Kartalov | F41B 6/003 | |

* cited by examiner

*Primary Examiner* — Samir Abdosh
(74) *Attorney, Agent, or Firm* — Heber Martin Carbajal Chavez; Scott Bell

(57) ABSTRACT

A method for operating an electromagnetic coilgun system, the method comprising: an electromagnetic coilgun comprising: a barrel and a longitudinally extended electrical excitation coil; wherein the electrical excitation coil circumferentially surrounds a bore of the barrel, energizing the electrical excitation coil to produce a steady-state magnetic field within and around the bore of the barrel, the steady-state magnetic field extending along a longitudinal axis of the barrel; loading the barrel with a magnetic dipole projectile at a breech end of the barrel, wherein the loaded magnetic dipole projectile is oriented with a first magnetic dipole moment aligned to a magnetic field orientation of the steady state magnetic field; and firing the magnetic dipole projectile by magnetically propelling the magnetic dipole along the longitudinal axis of the bore by a magnetic force produced by the steady-state magnetic field within and around the bore of the barrel.

14 Claims, 6 Drawing Sheets

STEAD-FIELD COILGUN METHODS AND DEVICES

CROSS REFERENCE TO RELATED PATENT(S) AND APPLICATION(S)

This Patent Application is a Continuation of U.S. patent application Ser. No. 18/732,083, titled Steady-Field Coilgun Methods and Device filed on Jun. 3, 2024, the contents of which are expressly incorporated by reference as though set fourth in their entirety and to which priority is claimed. U.S. patent application Ser. No. 18/732,083, takes priority from U.S. Provisional Application No. 63/470,757, filed Jun. 2, 2023, and entitled Methods, Techniques, and Devices for Steady-Field Coil Gun which is hereby incorporated in its entirety by reference.

BACKGROUND

This disclosure, and the exemplary embodiments described herein, describe steady-field coilgun methods and devices. The implementation described herein is related to coilgun operational methods, and devices and systems pertaining to coilguns, however it is to be understood that the scope of this disclosure is not limited to such application and is applicable to other linear accelerators using a steady-field design as described herein.

SUMMARY

In accordance with one exemplary embodiment of the present disclosure, disclosed is a method for operating an electromagnetic coilgun system, the electromagnetic coilgun system including a barrel and a longitudinally extending electrical excitation coil, the electrical excitation coil including a first portion arranged circumferentially around a muzzle end of a bore of the barrel and a second portion arranged circumferentially around a discharge region protruding beyond the muzzle end of the bore, the method comprising: energizing the electrical excitation coil to produce a steady-state magnetic field within and around the muzzle end of the bore of the barrel, the steady-state magnetic field extending along a longitudinal axis of the barrel and longitudinally beyond the muzzle end of the barrel; loading the barrel with a magnetic sabot at a breech end of the barrel, the magnetic sabot housing a nonmagnetic projectile; and firing the magnetic sabot and housed nonmagnetic projectile by magnetically propelling the magnetic sabot, with the housed nonmagnetic projectile, along the longitudinal axis of the bore by a magnetic force produced by the steady-state magnetic field within and around the bore of the barrel, wherein the magnetic sabot is shed from the nonmagnetic projectile as the magnetic sabot and nonmagnetic projectile are launched from the muzzle end of the bore.

In accordance with another exemplary embodiment of the present disclosure, disclosed is an electromagnetic coilgun system comprising: a barrel including a longitudinally extended bore, a breech end and a muzzle end; a longitudinally extended electrical excitation coil including a first portion arranged circumferentially around the muzzle end of the bore of the barrel and a second portion arranged circumferentially around a discharge region protruding beyond the muzzle end of the bore; wherein a) energizing the electrical excitation coil produces a steady-state magnetic field within and around the muzzle end of the bore of the barrel, the steady-state magnetic field extending along a longitudinal axis of the barrel and longitudinally beyond the muzzle end of the barrel, b) a magnetic sabot housing a nonmagnetic projectile is loaded at the breech end of the barrel, c) the magnetic sabot and housed nonmagnetic projectile are fired by magnetically propelling the magnetic sabot, and housed nonmagnetic projectile, along the longitudinal axis of the bore by a magnetic force produced by the steady-state magnetic field within and around the bore of the barrel, and d) the magnetic sabot is shed from the nonmagnetic projectile as the magnetic sabot and nonmagnetic projectile are launched from the muzzle end of the bore.

In accordance with another exemplary embodiment of the present disclosure, disclosed is a method for operating an electromagnetic coilgun system, the electromagnetic coilgun system including a barrel and a longitudinally extended electrical excitation coil arranged circumferentially around a bore of the barrel, the method comprising: energizing the electrical excitation coil to produce a steady-state magnetic field within and around the bore of the barrel, the steady-state magnetic field extending along a longitudinal axis of the barrel; loading the barrel with a magnetic dipole projectile at a breech end of the barrel, the loaded magnetic dipole projectile oriented with a first magnetic dipole moment aligned to a magnetic field orientation of the steady state magnetic field; and firing the magnetic dipole projectile by magnetically propelling the magnetic dipole along the longitudinal axis of the bore by a magnetic force produced by the steady-state magnetic field within and around the bore of the barrel; wherein, at or near a center of the electrical excitation coil, the magnetic dipole moment of the magnetic dipole projectile is flipped to be oriented to a second magnetic dipole moment, 180 degrees opposite to the first magnetic dipole moment and opposite to the magnetic field orientation of the steady state magnetic field, and the magnetic dipole projectile travels continuously from the breech end of the barrel, through the electrical excitation coil and is launched from the muzzle end of the bore of the barrel.

In accordance with another exemplary embodiment of the present disclosure, disclosed is an electromagnetic coilgun system comprising: a barrel including a longitudinally extended bore, a breech end and a muzzle end; a longitudinally extended electrical excitation coil arranged circumferentially around the bore of the barrel; and a magnetic dipole moment flipper located at or near a center of the electrical excitation coil, the magnetic dipole moment flipper reversing a dipole moment of a magnetic dipole projector traveling from the breech end of the barrel within the steady state magnetic field nearest the breech end of the barrel, the loaded magnetic dipole projectile oriented with a first magnetic dipole moment aligned to a magnetic field orientation of the steady state magnetic field, and the magnetic dipole projectile propelled along the longitudinal axis of the bore by a magnetic force produced by the steady-state magnetic field within and around the bore of the barrel.

In accordance with another exemplary embodiment of the present disclosure, disclosed is a method for operating an electromagnetic coilgun system, comprising a barrel and a longitudinally extended electrical excitation coil arranged circumferentially around a bore of the barrel, the method comprising: energizing the electrical excitation coil to produce a steady-state magnetic field within and around the bore of the barrel, the steady-state magnetic field extending along a longitudinal axis of the barrel; loading the barrel with a magnetic dipole projectile at a breech end of the barrel, the loaded magnetic dipole projectile oriented with a first magnetic dipole moment aligned to a magnetic field orientation of the steady state magnetic field; and firing the magnetic dipole projectile by magnetically propelling the magnetic dipole along the longitudinal axis of the bore by a magnetic force produced by the steady-state magnetic field within and around the bore of the barrel; wherein, at or near a center of the electrical excitation coil, the magnetic dipole moment of the magnetic dipole projectile may be flipped to be oriented to a second magnetic dipole moment, 180 degrees opposite to the first magnetic dipole moment and opposite to the magnetic field orientation of the steady state magnetic field, and the magnetic dipole projectile travels continuously from the breech end of the barrel, through the electrical excitation coil and may be launched from the muzzle end of the bore of the barrel. The magnetic dipole projectile includes a permanent magnet made of a ferromagnetic material comprising iron, cobalt, nickel, Alnico, ferrite, or a rare-earth material comprising neodymium or samarium-cobalt. The magnetic dipole flip may be caused by a curb inside the barrel which applies a torque onto the magnetic dipole projectile to produce a rotation for the flip. The barrel bore may be smooth before a center of the electrical excitation coil but may be rifled or partially rifled in a region of the barrel bore after the magnetic dipole may be flipped. Wherein a plurality of electrical excitation coil stages may be used to accelerate the magnetic dipole projectile and may be positioned at different longitudinal locations along the barrel, the output of each stage the input to the next stage, except for the last stage, whose output may be the muzzle end of the barrel. Wherein a magnetic field of a next stage may be opposite to a magnetic field of a previous stage, so that a flipped magnetic dipole projectile emerging from the previous stage has a dipole moment in the same direction as the magnetic field of the next stage to accelerate the magnetic dipole projectile into the electrical excitation coil of the next stage. Wherein a magnetic field of a next stage may be aligned to the magnetic field of a previous stages, so that a twice flipped magnetic dipole projectile emerging from the previous stage has its dipole moment in the same direction as the magnetic field of the next stage to accelerate the magnetic dipole projectile into the electrical excitation coil of the next stage. The barrel bore may be smooth everywhere except in an initial section of a first stage of the barrel bore nearest the breech end of the barrel to impart an initial rotation for the instability effect. The magnetic dipole projectile has three different principal moments of inertia and may be magnetized with a dipole moment pointing along its intermediate axis. The magnetic dipole projectile may be in the shape of a rectangular prism of dimensions a, b and c, where a>b>c, and the magnetic dipole projectile may be magnetized in a direction of an intermediate principal axis. Wherein an initial rotation around an intermediate axis may be brought about by rifling inside the initial section of the barrel, in combination with an acceleration from the magnetic force on the magnetic dipole projection from the electrical excitation coil. The barrel may be slotted along a longitudinal length to disallow a formation of circular eddy currents by an electromotive force induced by a varying magnetic flux generated by a motion of the magnetic dipole projectile inside the barrel bore. The slotted barrel may be also used as a means of venting air in lateral directions, to decrease air pressure buildup in front of the magnetic dipole projectile and thus decrease an overall deceleration due to air resistance. The multiple magnetic dipole projectiles may be accelerated through the barrel at the same time, resulting in an increased rate of fire.

In accordance with another exemplary embodiment of the present disclosure, disclosed is an electromagnetic coilgun system comprising: a barrel comprising a longitudinally extended bore, a breech end and a muzzle end; a longitudinally extended electrical excitation coil arranged circumferentially around the bore of the barrel; and a magnetic dipole moment flipper located at or near a center of the electrical excitation coil, the magnetic dipole moment flipper reversing a dipole moment of a magnetic dipole projector traveling from the breech end of the barrel within the steady state magnetic field nearest the breech end of the barrel, the loaded magnetic dipole projectile oriented with a first magnetic dipole moment aligned to a magnetic field orientation of the steady state magnetic field, and the magnetic dipole projectile propelled along the longitudinal axis of the bore by a magnetic force produced by the steady-state magnetic field within and around the bore of the barrel. The magnetic dipole projectile includes a permanent magnet made of a ferromagnetic material comprising iron, cobalt, nickel, Alnico, ferrite, or a rare-carth material comprising neodymium or samarium-cobalt. The magnetic dipole flip may be caused by a curb inside the barrel which applies a torque onto the magnetic dipole projectile to produce a rotation for the flip. The barrel bore may be smooth before a center of the coil but may be rifled or partially rifled in a region of the barrel bore after the magnetic dipole may be flipped. Wherein a plurality of electrical excitation coil stages may be used for acceleration of the magnetic dipole projectile and may be positioned at different longitudinal locations along the barrel, the output of each stage the input to the next stage, except for the last stage, whose output may be the muzzle end of the barrel. Wherein a magnetic field of a next stage may be opposite to a magnetic field of a previous stage, so that a flipped magnetic dipole projectile emerging from the previous stage has a dipole moment in the same direction as the magnetic field of the next stage to accelerate the magnetic dipole projectile into the electrical excitation coil of the next stage. Wherein a magnetic field of a next stage may be aligned to the magnetic field of a previous stages, so that a twice flipped magnetic dipole projectile emerging from the previous stage may have its dipole moment in the same direction as the magnetic field of the next stage to accelerate the magnetic dipole projectile into the electrical excitation coil of the next stage. The barrel bore may be smooth everywhere except in an initial section of a first stage of the barrel bore nearest the breech end of the barrel to impart the initial rotation for the instability effect. The magnetic dipole projectile may have three different principal moments of inertia and may be magnetized with a dipole moment pointing along its intermediate axis. The magnetic dipole projectile may be in the shape of a rectangular prism of dimensions a, b and c, where a>b>c, and the magnetic dipole projectile may be magnetized in a direction of an intermediate principal axis. Wherein an initial rotation around an intermediate axis may be brought about by rifling inside the initial section of the barrel, in combination with an acceleration from the magnetic force on the magnetic dipole projection from the electrical excitation coil. The barrel may be slotted along a longitudinal length to disallow a formation of circular eddy currents by an electromotive force induced by a varying magnetic flux generated by a motion of the magnetic dipole projectile inside the barrel bore. The slotted barrel may be also used as a means of venting air in lateral directions, to decrease air pressure buildup in front of the magnetic dipole projectile and thus decrease an overall deceleration due to air resistance. Wherein multiple magnetic dipole projectiles may be accelerated through the barrel at the same time, resulting in an increased rate of fire.

BRIEF DESCRIPTION OF THE DRAWINGS

For a more complete understanding of the present disclosure, reference is now made to the following descriptions taken in conjunction with the accompanying drawings.

DETAILED DESCRIPTION

Figure 1:
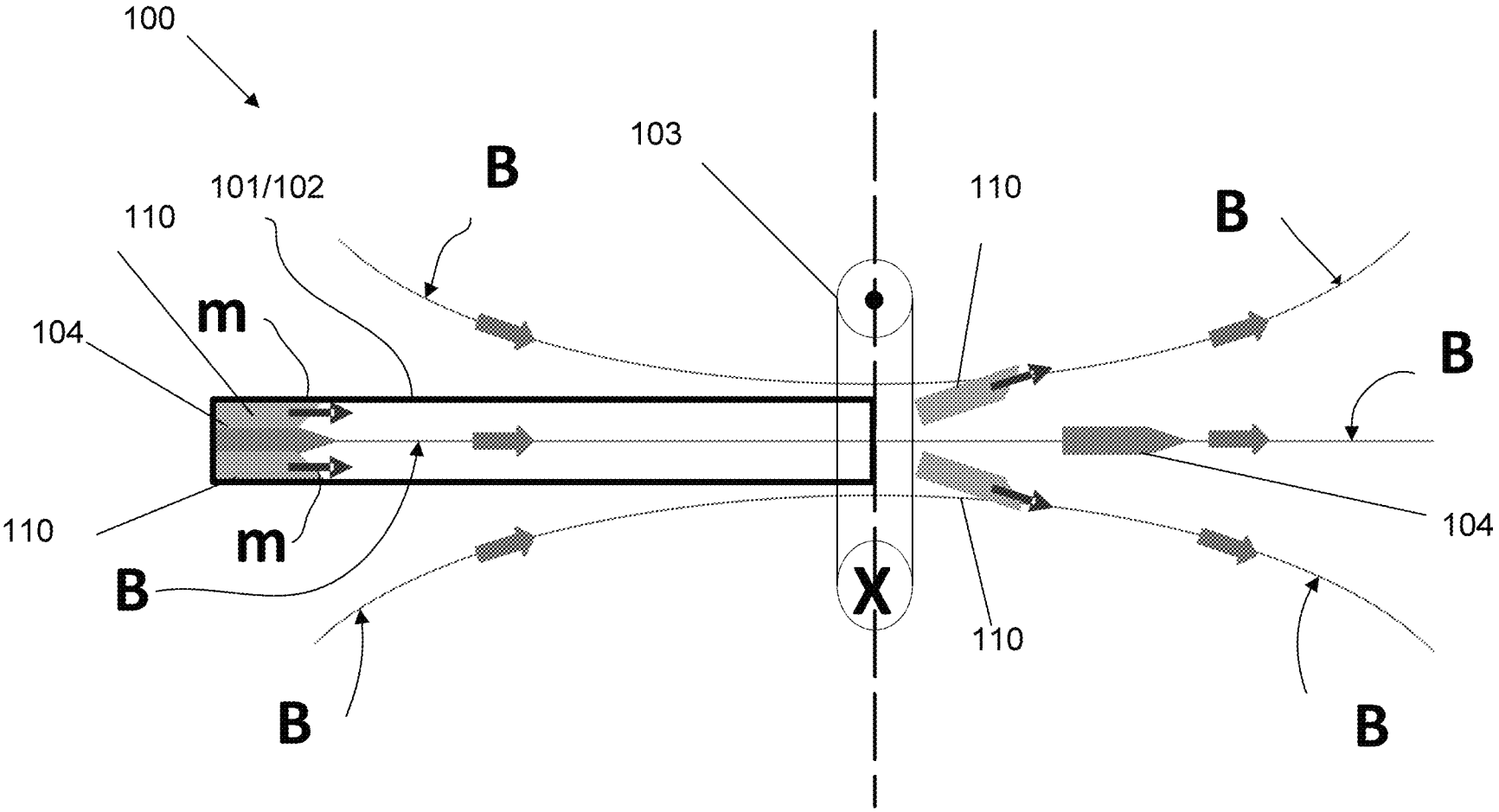
FIG. 1 shows a Single-Loop Discarding-Sabot Steady-Field Coilgun according to an example embodiment of this disclosure.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The term "solenoid", as used herein, refers to a coil, electrical excitation coil, current loop, etc.

Introduction

Coilguns are a promising alternative to traditional firearms based on chemical energy. Instead of chemical propellant, the coilgun uses magnetic fields to accelerate a magnetized bullet. Avoidance of a chemical charge means avoidance of the need to load, lock, fire, extract, and eject a shell. It also means a significant reduction in weight of ammunition because most of the weight of a traditional cartridge is comprised of shell and propellant. Lack of chemical propellant means less wear on the rifling and barrel. The use of electrical power means the coilgun can be directly connected to vehicle or ship power systems. Firing without the release of hot compressed gases also means significantly reduced sound signature and no light signature of the firing, producing a naturally suppressed firing system. As there is no spent shell to be extracted and ejected, the rate of fire is not limited by mechanical components associated with such needs, while a large percentage of potential mechanical malfunctions is completely circumvented. As firing does not involve the generation of hot gasses, though friction on the rifling would remain, the overall heating of the system is reduced, which would lead to higher firing rates and/or longer firing before cooling becomes necessary.

A typical coilgun accelerates a magnetized bullet through a system of magnetic fields produced by a succession of solenoids. Typically, these solenoids are activated in a sequence wherein the passage of the bullet is registered by photosensors along the barrel and used to trigger the next coil. As demonstrated by commercial small arms coilguns, typically achieved are muzzle velocities of ~50 m/s. However, this system requires charging and discharging solenoids for every shot, which is energetically wasteful, as magnetic fields are built up and then turned off, fighting the impedance of the system along both paths. In addition, since this needs to be done very rapidly, large currents need to be supplied, leading to further enhanced energy loss through Joule heating.

Herein, disclosed is an alternative approach based on a steady-field solenoid. The basic idea is to leave the current running in the solenoid during the operation of the gun. This means the field must be built up only once—initially, when turning the gun on. Then firing involves loading a bullet or other projectile in the barrel and releasing it to be accelerated by the established magnetic field. To fire again, the system loads the next bullet into the barrel and releases it again to be accelerated by the same steady magnetic field. To stop the firing, simply prevent the next bullet from loading, or load it but do not release it in the barrel. To turn off the system, simply disconnect the DC voltage driving the current in the solenoid. As a result, the field must be built up only once and taken down only once during a period of continuous operation of the coilgun. One advantage of this disclosed method and system is the avoidance of recurrent energy expenditure in setting up the magnetic field in the system.

An alternative way to think about the energy efficiency of the disclosed steady-field coilgun vs the traditional varying field coilguns, is to think in terms of radiation. A time-varying magnetic field will induce an electric field based on Faraday's law. The result would be radiation as given by a non-zero Poynting vector, as both the electric and magnetic fields are not zero. This means that energy leaves the traditional coilgun system as electromagnetic waves, because the magnetic field must be rapidly built up and then drawn down, in a rapid succession. The result is essentially an antenna. In contrast, the present disclosure, and example embodiments described herein, utilize a steady magnetic field, which is time-independent and thus does not induce an electric field. The magnetized round, i.e., bullet, projectile, or sabot as described herein, itself would induce a counter EMF in the coil, which would account for correct energy balance and would temporarily try to lower the overall current in the driving coil. However, overall, the associated Poynting vector is essentially zero. So, there is no appreciable loss through electromagnetic radiation. Hence, the disclosed steady-field gun is inherently more energy-efficient than traditional varying-field coilguns.

One of the challenges of the disclosed methods, systems and devices is to maximize the achieved muzzle velocity. The issue being is that in a standard constant-pitch solenoid, the magnetic force on the bullet will reverse direction when the bullet reaches the middle of the solenoid. So, the bullet will be accelerated while traveling the first half of the solenoid length and then decelerated while traveling the second half of the solenoid length. More detailed calculations below both show that a bullet with a constant magnetic moment vector will stop at the same distance beyond the solenoid middle point as the distance it started accelerating from. The effect is demonstrated where a permanent magnet is released to travel through a straight plastic tube around which a uniform solenoid is wound and carries a steady current. If correctly oriented, the magnet gets sucked into the tube but eventually stops before reaching the other end, due to additional losses in mechanical friction.

Herein are provided solutions to this problem based on reversing the direction of the magnetic moment of the bullet or projectile at or around the middle of the solenoid. The result is that the magnetic force on the dipole will not reverse, although the gradient of the magnetic field magnitude will reverse. Hence, the bullet or projectile will continue accelerating beyond the midpoint, instead of slowing down and stopping in the traditional arrangement. The overall result is a functional steady-field coilgun. Provided and described herein are multiple example embodiments of coilguns, and methods of operating the same, to ensure the reversal of the magnetic dipole moment necessary for the acceleration effect.

Magnetic Force Analysis

An accelerator solenoid can be viewed as a system of parallel circular current hoops of the same radius R, bearing the same steady current, positioned coaxially, and spaced longitudinally according to some pitch function. For purposes of analysis, considered is an individual loop first.

The bullet itself can be viewed as a magnetic dipole, particularly if the size of the bullet is small compared to the dimensions of the coils. The magnetic force on that dipole is given by:

$$\vec{F} = \vec{\nabla}(\vec{m}\cdot\vec{B})$$

Chosen is a coordinate system where the x axis is the longitudinal symmetry axis of the coil. For simplicity, the origin is placed at the point of release (and thus the initial position) of the bullet. The magnetic field in vacuum along the symmetry axis of a circular loop of radius R, bearing steady current I, is then given by:

$$\vec{B} = \hat{x}\frac{\mu_0 I R^2}{2\left(R^2+(x-L)^2\right)^{3/2}}$$

Here L is the position of the center of the loop on the symmetry axis. The current direction in the loop is determined by the right-hand rule. So, the positive current would flow clockwise when looking into the positive x direction. Then, the force on the bullet anywhere along the symmetry axis would be given by:

$$\vec{F} = \vec{\nabla}(\vec{m}\cdot\vec{B}) = \vec{\nabla}\left(\vec{m}\cdot\hat{x}\frac{\mu_0 I R^2}{2\left(R^2+(x-L)^2\right)^{3/2}}\right)$$

This equation suggests that to maximize the force, the dot product needs to be maximized. That would happen when the magnetic dipole of the bullet points along the x axis. So, the bullet must be magnetized so that its magnetic dipole points along the barrel axis. Then the force will be given by:

$$\vec{F} = \vec{\nabla}\left(\vec{m}\cdot\hat{x}\frac{\mu_0 I R^2}{2\left(R^2+(x-L)^2\right)^{3/2}}\right) = (\pm m)\frac{\mu_0 I R^2}{2}\vec{\nabla}\left(\frac{1}{\left(R^2+(x-L)^2\right)^{3/2}}\right)$$

Here, assumed is that the current in the loop is constant. That neglects the counter current that would be induced in the loop by the motion of the dipole with respect to the loop. One rationale for that choice could be that the induced current is small compared to the coil current. The plus/minus in front of m (magnetic dipole) leaves the option to point m along either the positive or negative direction of the x axis. The gradient operator in Cartesian coordinates is given by:

$$\vec{\nabla} = \hat{x}\frac{\partial}{\partial x} + \hat{y}\frac{\partial}{\partial y} + \hat{z}\frac{\partial}{\partial z}$$

So $$\vec{\nabla}\left(\frac{1}{\left(R^2+(x-L)^2\right)^{3/2}}\right) = \left(\hat{x}\frac{\partial}{\partial x} + \hat{y}\frac{\partial}{\partial y} + \hat{z}\frac{\partial}{\partial z}\right)\left(\frac{1}{\left(R^2+(x-L)^2\right)^{3/2}}\right) =$$

$$\hat{x}\frac{\partial}{\partial x}\left(\frac{1}{\left(R^2+(x-L)^2\right)^{3/2}}\right) + 0 + 0 =$$

$$\hat{x}\left(-\frac{3}{2}\right)\left(R^2+(x-L)^2\right)^{-5/2}2(x-L) = -3\hat{x}\frac{(x-L)}{\left(R^2+(x-L)^2\right)^{5/2}}$$

Hence, the force will be:

$$\vec{F} = (\pm m)\frac{\mu_0 I R^2}{2}\vec{\nabla}\left(\frac{1}{\left(R^2+(x-L)^2\right)^{3/2}}\right) = (\pm m)\frac{\mu_0 I R^2}{2}(-3)\hat{x}\frac{(x-L)}{\left(R^2+(x-L)^2\right)^{5/2}}$$

$$\vec{F} = \mp\hat{x}\frac{3\mu_0 I R^2 m}{2M}\frac{(x-L)}{\left(R^2+(x-L)^2\right)^{\frac{5}{2}}}$$

Then the acceleration of the bullet will be given by Newton's second law:

$$\vec{F} = M\vec{a}$$

Hence:

$$\vec{a} = \frac{\vec{F}}{M} = \mp\hat{x}\frac{3\mu_0 I R^2 m}{2M}\frac{(x-L)}{\left(R^2+(x-L)^2\right)^{\frac{5}{2}}}$$

It is desired to have the acceleration to be positive, so that the bullet is accelerated forward. On the other hand, the bullet starts at x=0, so x–L<0 initially. Therefore, an upper sign is picked to produce a positive acceleration for x<L. This corresponds to the dipole pointing in the positive x direction at release. Hence:

$$\vec{a} = -\hat{x}\frac{3\mu_0 I R^2 m}{2M}\frac{(x-L)}{\left(R^2+(x-L)^2\right)^{\frac{5}{2}}} = \hat{x}\frac{3\mu_0 I R^2 m}{2M}\frac{(L-x)}{\left(R^2+(L-x)^2\right)^{\frac{5}{2}}}$$

As the bullet travels along the barrel, x will change, but a, the acceleration, will remain parallel to the barrel axis. So, the vectors can be dropped and only projections are considered:

$$a(x) = \frac{3\mu_0 I R^2 m}{2M} \frac{(L-x)}{\left(R^2 + (L-x)^2\right)^{\frac{5}{2}}}$$

The analysis can be further simplified by stipulating that the bullet, or projectile, is made of ferrite, so its residual magnetization (remanence) field is $B_r$=0.35 Tesla and its mass density is ~5,000 kg/m$^3$. It should be noted that much higher remanence can be achieved by Alnico magnets, which are an iron alloy that includes aluminum, nickel, copper, and sometimes titanium. The remanence then is $B_r$=1.3 Tesla, while the density is ~6,900 kg/m$^3$. This remains an option for high-performance ammunition, but the extra cost of the metals can be a deterrent to mass use. Other options include rare-earth magnets, e.g., samarium-cobalt and neodymium-iron alloys, which would be even more expensive. Then inside the material it should be true that:

$$\vec{H} = \frac{1}{\mu_0}\vec{B_r} - \vec{\mathcal{M}}$$

But here H=0, because there are no free currents, while $B_r$ must be the remanence field. Hence, the magnetization of the material must be given by:

$$\vec{\mathcal{M}} = \frac{1}{\mu_0}\vec{B_r}$$

On the other hand, by definition, magnetization is the total dipole moment per unit volume. Volume is mass over mass density. Hence, for the bullet:

$$\vec{\mathcal{M}} = \frac{\vec{m}}{\mathcal{V}} \text{ so } m = \mathcal{M}\mathcal{V} = \frac{\mathcal{M}M}{\rho}$$

From above, the acceleration includes a constant factor of $$\frac{\mu_0 m}{M} = \mu_0 \frac{\mathcal{M}M}{\rho M} = \frac{\mu_0 B_r}{\mu_0 \rho} = \frac{B_r}{\rho}$$

Hence, $$a(x) = \frac{3\mu_0 I R^2 m}{2M} \frac{(L-x)}{\left(R^2 + (L-x)^2\right)^{\frac{5}{2}}} = \frac{3IB_r R^2}{2\rho} \frac{(L-x)}{\left(R^2 + (L-x)^2\right)^{\frac{5}{2}}}$$

$$a(x) = \ddot{x} = \frac{3IB_r R^2}{2\rho} \frac{(L-x)}{\left(R^2 + (L-x)^2\right)^{\frac{5}{2}}}$$

This is a nonlinear differential equation that would not be easy to solve. However, a trick can be applied because there is no need to solve for x(t), since all we care about is the muzzle velocity. Hence, instead of integrating over time, integrate over distance:

$$\ddot{x} = a(x) = \frac{dV}{dt} \text{ hence } dV = a(x)dt = \frac{a(x)dx}{V} \text{ so } VdV = a(x)dx$$

-continued $$\int_0^u VdV = \int_0^X a(x)dx = \frac{u^2}{2}$$

The same result can equivalently be obtained by equating the change in kinetic energy of the dipole, with the work done by the magnetic field, calculated as the line integral of the magnetic force on the dipole.

Here it makes sense to take the integration to some X, because then when the equation is solved, u(X) is obtained, i.e., the exit velocity as a function of the location at which the integral is terminated.

$$\frac{u^2}{2} = \int_0^X a(x)dx = \int_0^X \frac{3IB_r R^2}{2\rho} \frac{(L-x)}{\left(R^2 + (L-x)^2\right)^{\frac{5}{2}}} dx$$

A simple substitution should make solving the integral easier:

$$z \equiv x - L$$

$$u^2 = \int_{-L}^{X-L} \frac{3IB_r R^2}{\rho} \frac{(-z)}{\left(R^2 + (-z)^2\right)^{\frac{5}{2}}} dz = -\int_{-L}^{X-L} \frac{3IB_r R^2}{\rho} \frac{z}{\left(R^2 + z^2\right)^{\frac{5}{2}}} dz$$

$$u^2 = -\int_{z=-L}^{z=X-L} \frac{3IB_r R^2}{\rho} \frac{dz^2}{\left(R^2 + z^2\right)^{\frac{5}{2}}} = -\int_{z=-L}^{z=X-L} \frac{3IB_r R^2}{\rho} \frac{d\left(R^2 + z^2\right)}{\left(R^2 + z^2\right)^{\frac{5}{2}}}$$

The solution would benefit from a further substitution:

$$y \equiv R^2 + z^2$$

$$u^2 = -\int_{z=-L}^{z=X-L} \frac{3IB_r R^2}{2\rho} \frac{d\left(R^2 + z^2\right)}{\left(R^2 + z^2\right)^{\frac{5}{2}}} =$$

$$-\int_{R^2+L^2}^{R^2+(X-L)^2} \frac{3IB_r R^2}{2\rho} \frac{dy}{y^{\frac{5}{2}}} = \frac{IB_r R^2}{\rho} y^{-3/2} \Big|_{R^2+L^2}^{R^2+(X-L)^2}$$

$$u^2 = \frac{IB_r R^2}{\rho} \left[ \frac{1}{\left(R^2 + (X-L)^2\right)^{3/2}} - \frac{1}{\left(R^2 + L^2\right)^{3/2}} \right]$$

This equation will work up to X=2L, at which point the velocity will go to zero. In a sense, this is a symmetric oscillator, analogous to simple harmonic oscillator. The acceleration is symmetric around the center (here at X=L) and only dependent on position. So, it makes sense that the velocity would be zero at the amplitudes. The maximal velocity will be achieved when the denominator of the first term in the sum is minimized. That happens at X=L, i.e., at the center of the solenoid, as expected.

The above analysis assumes that the bullet will maintain a constant vector of magnetic moment throughout the motion. As a result, the analysis predicts the known result that the bullet will stop at (or before, if there is mechanical friction) the same distance from the midpoint on the other side, as the distance between the starting point and the midpoint. This analysis also explains why traditional coil-guns utilize time-varying fields. However, herein we provide alternative solutions based on the above analysis.

Discarding Magnetic Sabot

One solution to the above problem is the use of a magnetic sabot that propels a non-magnetic projectile core. The coilgun is then arranged with the barrel terminating at the center of the loop. The projectile is accelerated mechanically by the sabot, which is accelerated magnetically. For example, the sabot can be made of four segments that are insulated from one another longitudinally, to prevent the formation of eddy currents akin to magnetic braking. The segments can then flare out after they leave the barrel, e.g., due to air resistance. Once they flare out, they release the non-magnetic projectile, which is free to continue forward motion and does not experience the decelerating force from the loop. A basic diagram is shown in FIG. 1, showing a Single-Loop Discarding-Sabot Steady-Field Coilgun 100 according to an example embodiment of this disclosure, B shows the magnetic field lines and m shows the magnetic dipole orientation of a sabot 110.

The sabot fragments 110 do not reverse dipole direction past the center of the loop 103 and thus would be decelerated, potentially helping with the flaring of the sabot 110 and the release of the projectile 104 from the barrel 101/bore 102. The loop's 103 magnetic field diverges away from the center of the loop and so would produce torques on the sabot fragments 110 rotating them outward and thus helping with the shedding process.

To calculate the muzzle velocity in this arrangement, the analysis above is used where the integral is terminated at the loop center. The built-up velocity is calculated at the midpoint by plugging in X=0:

$$u_{mid}^2 = \frac{IB_rR^2}{\rho}\left[\frac{1}{(R^2+(0-L)^2)^{3/2}} - \frac{1}{(R^2+L^2)^{3/2}}\right] = \frac{IB_rR^2}{\rho}\left[\frac{1}{R^3} - \frac{1}{(R^2+L^2)^{3/2}}\right]$$

Since it is desired to maximize the velocity, it is desired to have the quantity in the brackets to be as large as possible, which will happen when L>>R. In that case, an approximation can be made and simplify further:

$$u_{mid}^2 = \frac{IB_rR^2}{\rho}\left[\frac{1}{R^3} - \frac{1}{(R^2+L^2)^{3/2}}\right] = \frac{IB_rR^2}{\rho}\left[\frac{1}{R^3} - \frac{1}{L^3\left(1+\frac{R^2}{L^2}\right)^{3/2}}\right] \cong \frac{IB_rR^2}{\rho}\left[\frac{1}{R^3} - \frac{1}{L^3}\right]$$

$$u_{mid}^2 \cong \frac{IB_rR^2}{\rho R^3}\left[1 - \frac{R^3}{L^3}\right] \cong \frac{IB_r}{\rho R} \text{ so } u_{mid} \cong \sqrt{\frac{IB_r}{\rho R}}$$

The above analysis assumed that the entirety of the projectile is magnetic. For this approach to work, a non-magnetic core is needed, so the core does not get decelerated after the loop center. To use the same analysis, the force is adjusted by a factor equal to the fraction of the magnetic sabot mass within the total mass of the projectile. For example, if the sabot mass is 90% of the total mass, the force and acceleration will be reduced to f=0.9x of the original value, as only 90% of the mass contributes to the magnetic force. On the other hand, the acceleration would still be forced over the total mass, so the acceleration would decrease by the same factor f. Then:

$$u_{muzzle\ sabot} \cong \sqrt{\frac{fIB_r}{\rho R}}$$

The square root dependence would be beneficial in the design of heavy projectiles. For example, a magnetic sabot that is just 25% of the total mass will result in a muzzle velocity of half the value for a fully magnetic projectile. On the other hand, the projectile core would carry away most of the invested energy (~75% here).

On the other hand, if trying to maximize velocity for light projectiles, 81% sabot would mean 90% velocity, i.e., a loss of just 10% due to the use of sabot. However, the tradeoff would be that a heavier sabot means a smaller percentage of the total energy will end up with the projectile core (~19% in this example).

Flipping Dipole Moment

As discussed above, if the dipole maintains direction, it will be initially accelerated then decelerated by the magnetostatic field of a loop. However, reversing the magnetic dipole moment of the bullet offers an alternative solution.

If the dipole reverses direction at the midpoint, the bullet would continue accelerating past that point, instead of decelerating. The built-up velocity is calculated at the midpoint by plugging in X=0:

$$u_{mid}^2 = \frac{IB_rR^2}{\rho}\left[\frac{1}{(R^2+(0-L)^2)^{3/2}} - \frac{1}{(R^2+L^2)^{3/2}}\right] = \frac{IB_rR^2}{\rho}\left[\frac{1}{R^3} - \frac{1}{(R^2+L^2)^{3/2}}\right]$$

Since it is desired to maximize the velocity, it is desired to have the quantity in the brackets be as large as possible, which will happen when L>>R. In that case, an approximation can be made and simplify further:

$$u_{mid}^2 = \frac{IB_rR^2}{\rho}\left[\frac{1}{R^3} - \frac{1}{(R^2+L^2)^{3/2}}\right] = \frac{IB_rR^2}{\rho}\left[\frac{1}{R^3} - \frac{1}{L^3\left(1+\frac{R^2}{L^2}\right)^{3/2}}\right] \cong \frac{IB_rR^2}{\rho}\left[\frac{1}{R^3} - \frac{1}{L^3}\right]$$

$$u_{mid}^2 \cong \frac{IB_rR^2}{\rho R^3}\left[1 - \frac{R^3}{L^3}\right] \cong \frac{IB_r}{\rho R} \text{ so } u_{mid} \cong \sqrt{\frac{IB_r}{\rho R}}$$

Then, the integration is redone with new limits and an acceleration taken with a negative sign:

$$\int_{u_{mid}}^{u_{fin}} VdV = \int_L^\infty a(x)dx = \frac{u_{fin}^2 - u_{mid}^2}{2}$$

$$\int_L^\infty a(x)dx = \int_L^\infty\left[-\frac{3IB_rR^2}{2\rho}\frac{(L-x)}{(R^2+(L-x)^2)^{\frac{5}{2}}}\right]dx = \int_{x=L}^\infty\left[\frac{3IB_rR^2}{2\rho}\frac{(x-L)}{(R^2+(x-L)^2)^{\frac{5}{2}}}\right]dx$$

Again substitute:

$$z \equiv x - L$$

So $$\int_L^\infty a(x)dx =$$

$$\int_0^\infty \frac{3IB_rR^2}{2\rho}\frac{z}{(R^2+z^2)^{\frac{5}{2}}}dz = \int_{z=0}^\infty \frac{3IB_rR^2}{4\rho}\frac{dz^2}{(R^2+z^2)^{\frac{5}{2}}} = \int_{z=0}^\infty \frac{3IB_rR^2}{4\rho}\frac{d(R^2+z^2)}{(R^2+z^2)^{\frac{5}{2}}}$$

Again substitute:

$$y \equiv R^2 + z^2$$

So $$\int_{z=0}^\infty \frac{3IB_rR^2}{4\rho}\frac{d(R^2+z^2)}{(R^2+z^2)^{\frac{5}{2}}} =$$

$$\frac{3IB_rR^2}{4\rho}\int_{y=R^2}^\infty y^{\frac{5}{2}}dy = -\frac{IB_rR^2}{2\rho}y^{-\frac{3}{2}}\Big|_{R^2}^\infty = \frac{IB_rR^2}{2\rho R^3} = \frac{IB_r}{2\rho R}$$

So $$\frac{u_{fin}^2 - u_{mid}^2}{2} = \int_L^\infty a(x)dx = \frac{IB_r}{2\rho R}$$

$$u_{fin}^2 = u_{mid}^2 + \frac{IB_r}{\rho R} \cong \frac{IB_r}{\rho R} + \frac{IB_r}{\rho R} = \frac{2IB_r}{\rho R}$$

$$u_{fin} \cong \sqrt{\frac{2IB_r}{\rho R}}$$

If the starting distance from the midpoint is large compared to the radius of the loop, it can just as well be considered to be infinity, to a reasonable approximation. Then the integral is symmetric for the two halves of the integration path (from infinity to the midpoint and from the midpoint to the opposite infinity). Hence, the contributions to the integral over the acceleration will be symmetric as well, but this time they add up instead of canceling, due to the inversion of the dipole moment direction at the midpoint.

If the barrel is long compared to the radius of the loop, the final velocity will essentially be "muzzle velocity" for the coilgun. What happens beyond that point can be handled by mechanics alone, since the magnetic force on the dipole dies off as the inverse cube of the distance and thus would become negligible rather quickly. Incidentally, the same observation can be inverted to state that the barrel itself does not have to be long, at least from the perspective of electromagnetism. More barrel length means longer distance to integrate over, but that approach will provide rapidly diminishing returns.

Flipping by Curb

Figure 2:
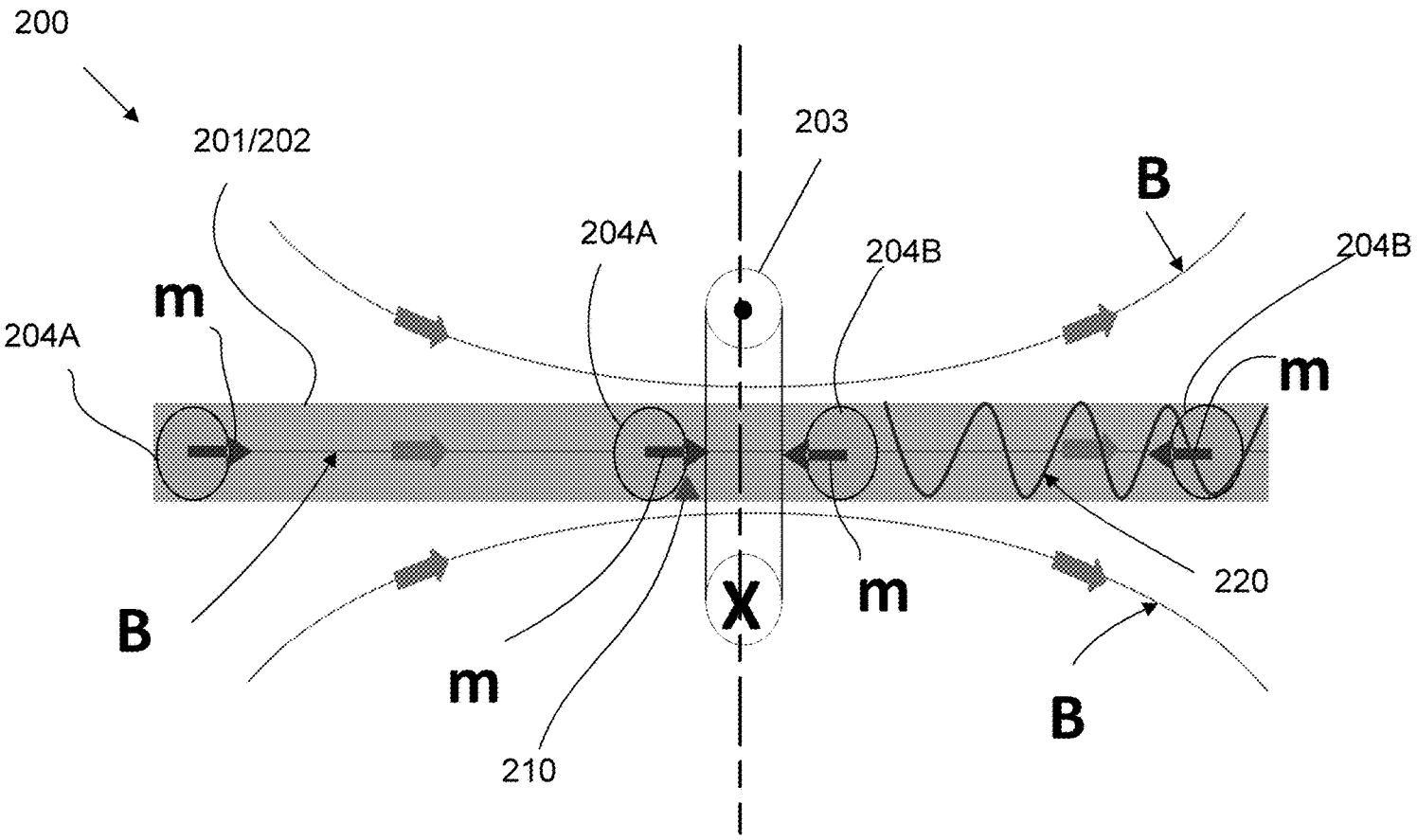
FIG. 2 shows a Single-Loop Curb-Flip Steady-Field Coilgun according to an example embodiment of this disclosure.

The specifics of the flip are further elaborated. One idea is to have a curb inside a smoothbore barrel. Due to rotational symmetry around the axis of travel, the curb can be positioned at any azimuthal angle of choice. It should produce a torque that will rotate the projectile around a lateral axis. For example, a round bullet would be easily rotated due to such a collision. A basic diagram is presented in FIG. 2, which shows a Single-Loop Curb-Flip Steady-Field Coilgun 200 according to an example embodiment of this disclosure, where B shows the magnetic field lines and m shows the magnetic dipole orientation of a projectile 204, including an initial orientation 204A and a flipped orientation 204B.

The next task would be to choose the longitudinal position of the curb 210, and thus to time the collision with the curb 210, so that the bullet 204 completes half a rotation (or an odd number of half rotations) by the time it has passed the center of the loop 203. This will ensure that no deceleration is to be experienced from the magnetic field in the travel through the second half of the barrel 201/bore 202. Instead, bullet 204 should continue being accelerated by the magnetic field, so long as the dipole orientation is maintained opposite to that of the magnetic field, in the second half of barrel 201. Of course, that will require stopping the rotation, e.g., as described below.

It should be noted that from the viewpoint of rotations around the center of mass, the dipole orientation is stable in the first half of the barrel but unstable in the second half. The reason is the torque on the dipole from the magnetic field:

$$\vec{N} = \vec{m} \times \vec{B}$$

A small deflection of the dipole direction from being aligned with the magnetic field would produce a torque that would rotate it back in alignment, in the first half of the barrel. Therefore, it is not required that the first half is rifled at all, since the direction of the magnetic field dipole will be maintained by the magnetic field alone already.

On the other hand, the dipole orientation in the second half of the barrel is unstable, because in that region, the magnetic dipole and the magnetic field are in opposite directions. Then a small deflection in the direction of the dipole moment will result in a torque that would make that deflection grow. On the other hand, the force on the dipole is the gradient of the dot product of m and B, so deflecting m from being parallel to B (magnetic field) would decrease the force, and thus the acceleration, and thus final velocity. For both reasons, maintaining the orientation of the dipole in the second half of the barrel is critical to optimal performance.

To stabilize the dipole orientation in the second half of the barrel, it then makes sense to use rifling. Rifling 220 will stop the curb-collision-induced tumble of bullet 204 around its center of mass. If timed correctly, it will also mean the bullet dipole moment will be locked parallel to the magnetic field, thereby maximizing the magnetic force on the dipole, and thus the acceleration and final velocity.

To recap, the overall design is a round bullet 204 or projectile, magnetized and loaded in a smoothbore barrel 201/202, wherein it aligns to the magnetic field and is accelerated to the center of loop 203. At the center or close before it, bullet 204 collides with a bump or curb 210 on the inside of barrel 201, which will make it rotate around its center of mass. The size of curb 210 can be optimized to produce the rotation without significant linear deceleration.

The rotation timing can be optimized so that the bullet is fully flipped on the other side of the loop center 203, at which point it is engaged by rifling 220 in the second half of the barrel 201. Rifling 220 stops the bullet's 204 rotation around a lateral axis but confers a rotation around the longitudinal axis of barrel 201. This locks the magnetic dipole moment direction to be parallel to the barrel axis but opposite to the field, which maximizes linear acceleration. The rifling 220 rotation also would stabilize the bullet ballistically, and thus is an added benefit.

A potential issue here is the influence of gyroscopic effect. Briefly, the gyroscopic effect is that if a rigid body rapidly rotates along an axis and a torque is applied to it along an axis perpendicular to the axis of rotation, the body will rotate along an axis perpendicular to both. So, if the bullet rapidly rotates along the longitudinal axis due to the rifling in the first half of the barrel, and the bullet experiences a torque along one lateral axis due to the curb, the bullet should end up tumbling along the other lateral axis. For the coilgun, the result is the same—the bullet will tumble, and its dipole moment will flip. So, the gyroscopic effect will somewhat complicate the optimization and timing but does not prevent them.

Flipping by Rotational Instability

Figure 3:
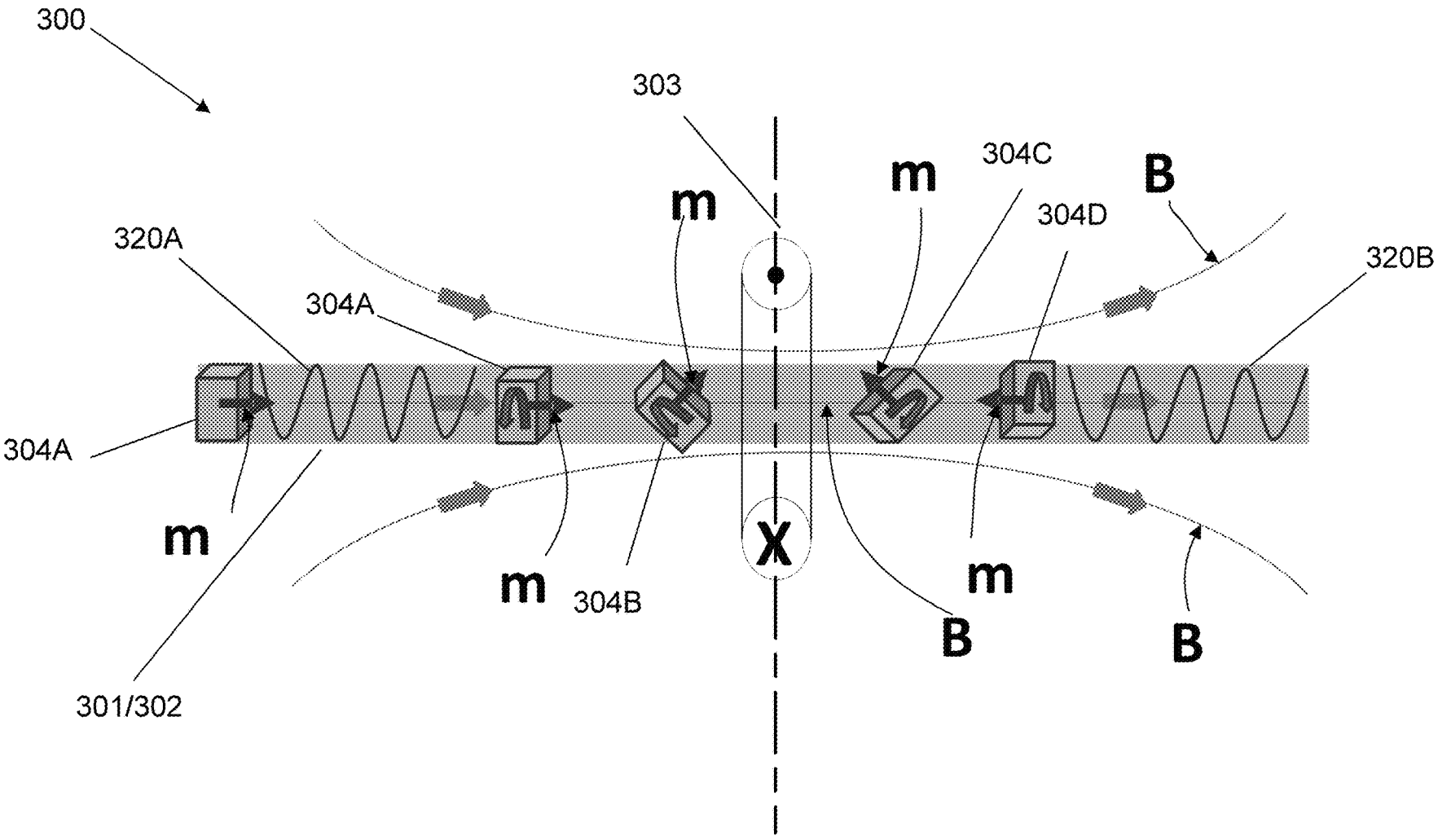
FIG. 3 shows a Rotational Instability Flip Steady-Field Coilgun according to an example embodiment of this disclosure.

An alternative method to flip the bullet dipole moment direction is to use rotational instability as prescribed by the Intermediate Axis theorem. Briefly, rigid body mechanics stipulates that if the three principal moments of inertia of a rigid body are all different, then rotation around the axis of largest or smallest moment is stable, but rotation around the axis of intermediate moment is unstable. A basic diagram is presented in FIG. 3, showing a Rotational Instability Flip Steady-Field Coilgun 300 according to an example embodiment of this disclosure, where B shows the magnetic field lines, m shows the magnetic dipole orientation of a projectile 304, including an initial orientation 304A, an intermediate orientation 304B, an intermediate orientation 304C and a flipped orientation 304D.

This theorem is advantageously used to design a bullet 304 that has three different principal moments of inertia, e.g., a rectangular-prism brick with all three dimensions being different (say a>b>c). It can be shown that the three principal axes in that case will pass through the center of the brick 304 (assuming uniform brick), while each axis passes through and is perpendicular to a corresponding set of parallel faces of the brick 304. Then the intermediate axis will be the one perpendicular to the faces of dimensions a×c (assuming a>b>c).

Next, the brick-shaped bullet 304 is magnetized, so that its dipole moment is oriented along the intermediate principal axis. When loaded in barrel 301, bullet 304 can be oriented to have the dipole point in the same direction as the magnetic field. Rifling 320A in the initial section of the barrel 301 should bestow a rotation along the barrel axis. After a certain distance along barrel 301, the rifling stops and the barrel becomes smoothbore. Leaving the rifling 320A should produce a deviation from perfect alignment, which should set a periodic flip of the direction of the dipole, due to the rotational instability. The flip period and the travel down barrel 301 can be optimized and timed to ensure that the bullet flips at or around the loop 303 center. This means that as the bullet 304 emerges on the other side of the loop 303, the dipole moment will now be opposite to the magnetic field, so the magnetic field will accelerate the dipole further out. Rifling 320B in the second half of the barrel 301 can ensure that the dipole orientation is maintained, to maximize the acceleration and prevent rotational instability and magnetic torque from further flipping the bullet 304.

It should be noted that the free rotation flipping due to rotational instability from the intermediate axis theorem is a process where the rigid body spends most of the time in an "aligned" state, i.e., with the intermediate axis being aligned or mostly aligned with the direction of the angular momentum. When the flipping does happen, it happens at much shorter timescales than the "aligned" state. This feature is perfect for the intended coilgun application. Correctly optimized timing should ensure that the bullet quickly flips dipole direction as the bullet passes through the loop center.

5. Upscaling from a Loop to a Solenoid

The above analysis simplified the solenoid to a single loop to make calculations easier. Now described is an upscaling from a single loop to a solenoid. The immediate advantage of this procedure is that the solenoid can be envisioned as a compilation of concentric loops of different radius and position on the barrel axis.

Figures 4A, 4B:
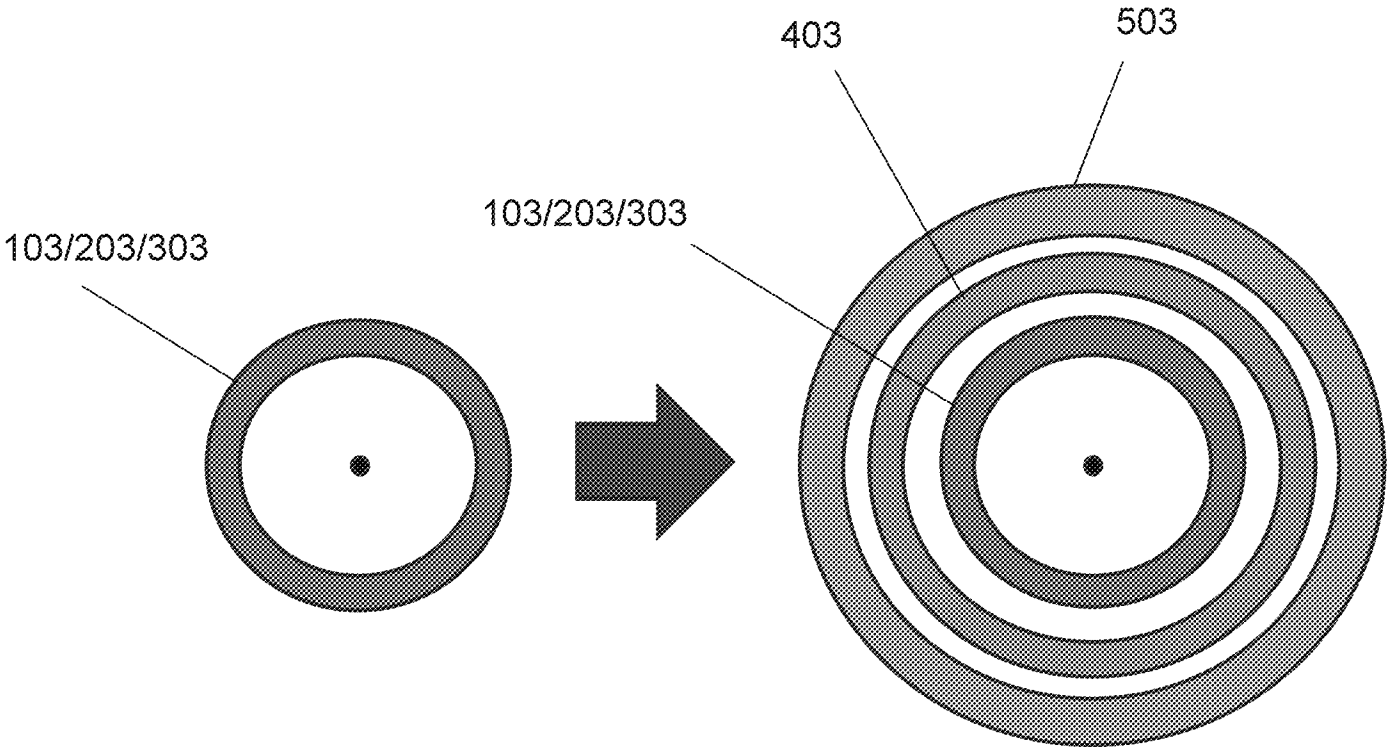
FIG. 4A shows a single accelerator coil and FIG. 4B shows concentric accelerator coils centered on the travel axis of a projectile, where the travel axis is coming out of the page on this diagram, according to an example embodiment of this disclosure.

A simple arrangement is to have many concentric loops such as 103/202/303 (FIG. 4A), as previously described, and 403 and 503 as shown in FIG. 4B, of differing radius but positioned at the same location on the axis. This will mean that the contributions can be collectively added, since the forces and respective imparted accelerations would be both additive and analogous. The result would be a final velocity of:

$$u_{fin\ flip} \cong \sqrt{\frac{2I_0B_r}{\rho}\sum\frac{N_i}{R_i}}$$

$$u_{fin\ sabot} \cong \sqrt{\frac{fI_0B_r}{\rho}\sum\frac{N_i}{R_i}}$$

In the above formula, $R_i$ is the radius of the i-th shell, while Ni is the number of turns inside the i-th shell. The summation is inside the square root because the initial integral equation has the square of the velocity on the left side. $I_0$ is the electric current in each turn of the solenoid.

It is clear from the acceleration integral that flipping too early or too late with respect to a particular loop would decrease the final velocity and thus degrade the overall performance of the gun. Hence, the positioning of the loops is ideally such that all share the same center, so that the dipole flips at the midpoint of every loop. The above formula for the final velocity reflects that assumption about the solenoid.

To work out a practical example, assume a ferrite bullet and $I_0$=10 Amperes, N=10,000, R=5 mm. Then, for the two approaches with flipping dipole, obtained is:

$$u_{fin\ ferrite} \cong \sqrt{\frac{2I_0B_rN}{\rho R}} = \sqrt{\frac{2\times10\times0.35\times10^4}{5\times10^3\times0.005}} = 10\times\sqrt{\frac{2\times70}{5}} = 10\times\sqrt{28} \cong 53\ \text{m/s}$$

If the coil stack is laterally expanded, with two more concentric coils with the same N but at radii of 10 mm and 15 mm.

Then the result is:

$$u_{fin\ ferrite\ 3coil} \cong \sqrt{\frac{2I_0B_r}{\rho}\sum\frac{N_i}{R_i}} = \sqrt{\frac{2I_0B_rN}{\rho}\left(\frac{1}{R_1}+\frac{1}{R_2}+\frac{1}{R_3}\right)}$$

$$u_{fin\ ferrite\ 3coil} \cong \sqrt{\frac{2\times10\times0.35\times10^4}{5\times10^3\times0.001}\times\left(\frac{1}{5}+\frac{1}{10}+\frac{1}{15}\right)} = 10^2\times\sqrt{1.4\times\frac{6}{15}} = 75\ \text{m/s}$$

For an Alnico bullet with a single coil of the above parameters, obtained is:

$$u_{fin\ Alnico} \cong \sqrt{\frac{2I_0B_rN}{\rho R}} = \sqrt{\frac{2\times10\times1.3\times10^4}{6.9\times10^3\times0.005}} = 10\times\sqrt{\frac{520}{6.9}} \cong 87\ \text{m/s}$$

For an Alnico bullet with a triple coil of the above parameters, obtained is:

$$u_{fin\ Alnico\ 3coil} \cong \sqrt{\frac{2\times10\times1.3\times10^4}{6.9\times10^3\times0.001}\times\left(\frac{1}{5}+\frac{1}{10}+\frac{1}{15}\right)} = 10^2\times\sqrt{\frac{26\times6}{6.9\times15}} \cong 123\ \text{m/s}$$

While further coils of ever greater radius can be added concentrically, the dependence of u on R shows that such an approach will have rapidly diminishing returns in terms of gains to the muzzle velocity.

The above results need be adjusted by a factor of square root of the f/2 for the discarding sabot. The result will clearly depend on the fraction of the sabot mass within the total starting projectile mass. For example, for f=0.98, the above velocities will be reduced by 30% (70% of above). For f=0.5, the above velocities will be halved.

Upscaling to Multiple Solenoids

Adding coils can improve performance. Multiple such approaches are discussed below.

Lengthening the Coil

Figure 5B:
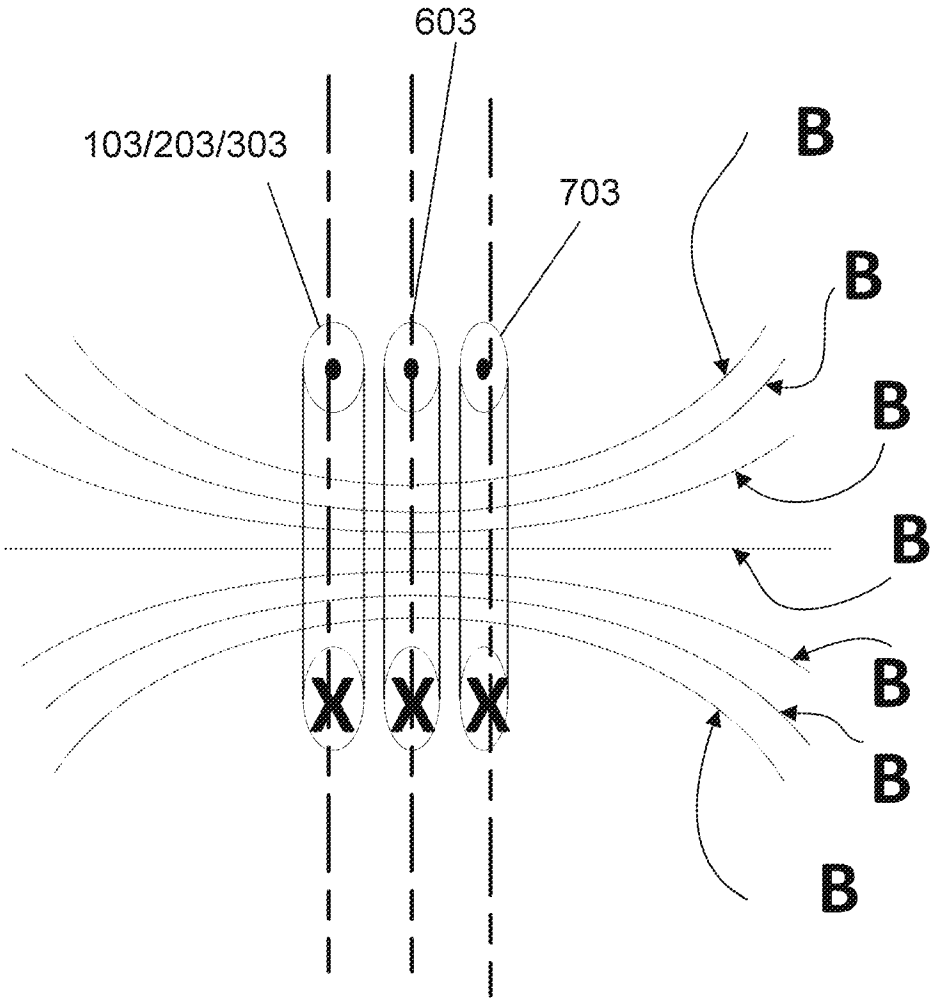
FIG. 5A shows a single coil and FIG. 5B shows adding coils strengthens the overall field relative to a single coil as shown in FIG. 5A, thereby increasing overall force and acceleration, according to an example embodiment of this disclosure.
Figure 5A:
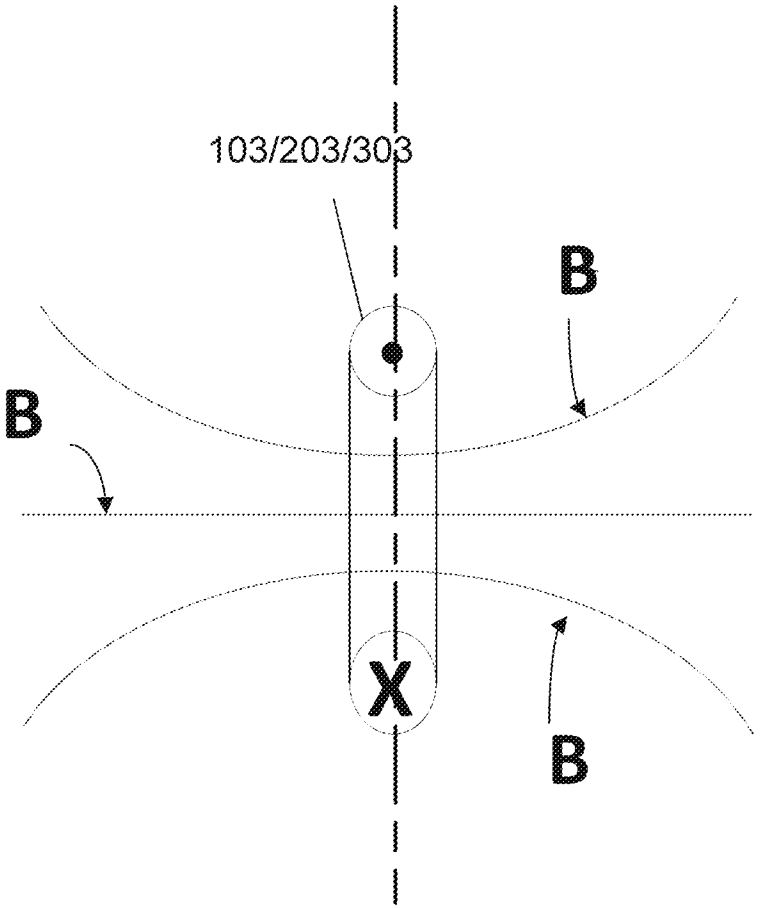

One approach is to add more coils immediately before and/or after the coil set described above. This will have the effect of lengthening the flip region, but it will also produce a stronger field. The general expectation is that the addition will increase overall muzzle velocity but would make timing and optimization more complicated. FIG. 5B gives a schematic representation, which shows adding coils strengthens the overall field, thereby increasing overall force and acceleration, as compared to a single loop arrangement (FIG. 5A), according to an example embodiment of this disclosure, where B shows the magnetic field lines.

As shown, adding coils 603 and 703 strengthens the overall field, increasing overall force and acceleration. It also makes the field more homogeneous in the middle, which will decrease the force in the middle section. On the other hand, it will also further homogenize the magnetic field inside the coil. More homogeneous magnetic field would mean less gradient of the magnetic field magnitude. This can be seen easily by noting that a perfect uniform infinitely long solenoid would produce a homogeneous magnetic field inside it. A longer coil will thus produce a more homogeneous yet stronger field. Because the gradient would depend on both the rate of change and the magnitude, the specific design of the coil can be optimized advantageously. If the field is overall strengthened everywhere, but it is made more homogeneous inside the coil, the bullet would accelerate more in the regions outside the coil, while inside the coil the deceleration due to imperfect timing can be reduced by the improved homogeneity.

Longitudinal Addition of Coil Stages

An alternative approach for further improvement is to add coil stages along the barrel length. The basic idea is to produce additional acceleration, as the magnetic force on the magnetic dipole is independent of velocity.

Figure 6:
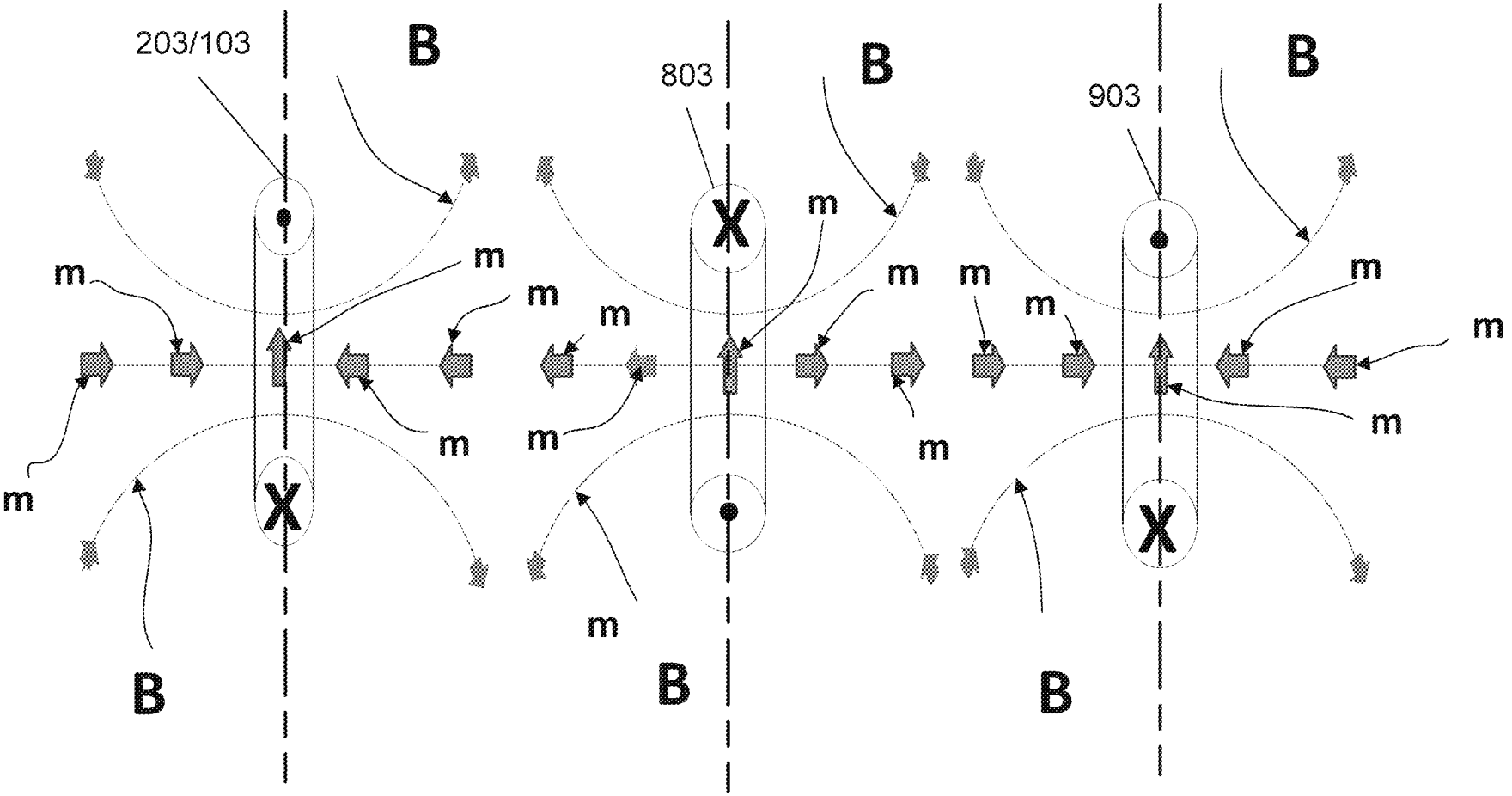
FIG. 6 shows three single-coil stages of consecutive acceleration using a flipping method according to an example embodiment of this disclosure.

For the discarding sabot, adding such stages will not help, because at the emergence from the first stage, the sabot would split up and the released projectile is non-magnetic. However, the flip approaches can in principle benefit from such additional stages. FIG. 6 shows a schematic representation including three stages according to an example embodiment of this disclosure, where B shows the magnetic field lines and m shows the magnetic dipole orientation of a projectile. According to this example embodiment, included are three single-coil stages 203/101/, 803 and 903 of consecutive acceleration using the flipping method. SN-NS-SN positioning of the stages takes advantage of the alternating flips of the magnetic dipole m to maximize force and corresponding acceleration. This positioning will stretch out the field lines B, increasing the inhomogeneity of the field and the gradient of the field magnitude.

For the flip approaches, after the first flip, the dipole of the bullet will be pointing in the negative x direction. The next identical stage 803 will be set up with current in the opposite direction, reversing the direction of the magnetic field to the negative x direction. Then the bullet will experience an attractive force pulling it into the next set of coils. So, the second stage can be a repeat of the first stage, except for the direction of the magnetic field. Then additional stages can be pasted further along the barrel in the same way. In this system the location of curbs and the required timing will have to change from stage to stage, because the bullet will travel faster in every stage and thus for the same length would have less time to rotate into position for the acceleration in the second half of each stage.

This means that at every stage of coils, the bullet will gain additional kinetic energy of the same amount as the first stage. So, after S stages, the total gained energy will be S times larger. Therefore, the final velocity after S stages will be square-root-of-S times larger than calculated above, i.e.

$$u_{fin\ after\ S\ stages} \cong \sqrt{\frac{2I_0B_rS}{\rho}\sum\frac{N_i}{R_i}}$$

So, four stages should double the muzzle velocity, while nine stages would triple it. That should make the Alnico bullet from the example above exceed Mach 1.

Note that all stages will have steady magnetic fields. The stages can be spaced sufficiently to have minimal interaction with each other. In addition, since the stages produce steady fields and do not move with respect to each other, they will not induce EMFs into one another.

In addition, it should be beneficial to arrange the consecutive coils in face-to-face or north-to-north and south-to-south positioning (SN-NS), because that will further spread out the field lines and thus increase the gradient of the magnetic field magnitude between two consecutive coils. Because the force is proportional to that gradient, a somewhat larger acceleration should be produced compared to a single coil assembly. That should compensate for not running the bullet to the infinity of a particular stage. Overall, it will allow for a somewhat shorter overall length of the gun for the same muzzle velocity, or alternatively achieve even larger muzzle velocity for the same overall length.

A further advantage of this staged SN-NS design is to have the overall magnetic field outside the gun be significantly lower than if the stages were positioned with matching field direction, e.g., SN-SN. This is useful for safety reasons. Also, smaller overall magnetic field at large distances mean less investment of energy into setting up the magnetic field, because the volumetric energy density of magnetostatic fields goes with the square of the magnetic field.

Since all the coils can run the same current at the same time, wiring becomes particularly simple for the steady-field coilgun. In the simplest geometry, one single wire can be wound many times to form the first coil, then extended in a straight line parallel to the barrel to the location of the next stage, then wound there in the opposite direction to set up the SN-NS arrangement, then again extended linearly to the next location, etc. This is far simpler than the design of a traditional coilgun, where multiple independent coils must be wired, triggered, and run separately.

Potential Technical Problems and Their Solutions

Barrel Magnetization

A potential issue with the disclosed method and system is that the bullet would still need to be rapidly spinning out of the muzzle for gyroscopic stabilization during the subsequent flight. To achieve this, a rifled barrel is needed. A traditional steel barrel would be ferromagnetic and would magnetize and then be demagnetized during every shot. This would be true for traditional coilguns made of arrays of coils being switched on and off in an appropriate sequence for every shot. A potential solution for them is to use non-ferromagnetic steel (e.g., 304 stainless steel) to avoid this issue.

However, this is not a problem in our disclosed steady-field system. In fact, magnetization would possibly be beneficial to our system as additional magnetic field in the same direction as the solenoid field would be set up by the magnetization of the ferromagnetic barrel, which ought to further increase the force on the bullet and thus increase the muzzle velocity.

Magnetic Braking

Another potential issue is that the use of a steel barrel to provide rifling and thus gyroscopic stabilization of the bullet would result in the bullet magnetic dipole inducing loop currents around the cross-section of the barrel, which would produce a magnetic field opposite to the field of the dipole and thus would work to decelerate the bullet during its flight through the barrel. The same phenomenon is used in magnetic braking and the effect grows stronger with increased magnitude of the magnetic dipole and with its increased velocity relative to the barrel.

The solution to this problem is a rifled barrel, which is segmented into longitudinal strips that are disconnected from one another azimuthally. As a result, loop currents cannot be established around the barrel and a strong magnetic counter-field would not be formed. These strips can be held together by a larger-diameter tube made of electrically non-conductive material.

In a simple arrangement, two concentric semi-cylindrical segments can be arranged parallel to the barrel axis and facing each other. Such segments would still support functional rifling, but the two longitudinal gaps between the two halves of the cylinder would prevent circular currents from forming.

In the simplest arrangement, the two semi-cylinders can be connected along one of the gaps, to simplify manufacture and improve structural strength, as a single longitudinal gap would still open the circuit and prevent the establishment of strong loop currents.

Wear and Tear

A further potential issue is that if the bullet is made of steel, it would wear down the rifling on stainless steel i.e., 304 stainless steel, barrel very quickly. The simple solution to this problem is to coat the steel bullet in a thin layer of copper, which is significantly softer than steel and would not wear down the rifling. Copper is also diamagnetic and so would have no appreciable effect on the magnetic properties of the steel bullet. Some modern firearm ammunition includes a steel armor-piercing core inside a lead slug with a copper jacket, e.g., the standard 7.62×39 Russian ammunition, so this specific solution is not new.

An alternative solution is to make the bullet out of pure iron, instead of steel. That would preserve the ferromagnetic properties of the bullet, but pure iron is significantly softer than steel and so should not wear down the steel rifling as quickly. If an armor-piercing effect is desired, then a steel core can be contained inside a slug of pure iron.

Air Resistance and Barrel Friction

The above calculations do not include air resistance and friction in the barrel. Each is not negligible but can be put aside in a basic-concept derivation, as neither is large enough to affect the qualitative conclusions. Both will simply contribute to a somewhat reduced muzzle velocity.

A potential partial solution to consider is that in the curb-flip design, the first half of the barrel will be smooth-bore anyway, which will avoid rifling deceleration in that section.

The effects of air resistance will be further mitigated due to the use of a slotted barrel necessary to prevent the occurrence of magnetic braking as described above. The already slotted barrel can be made to vent air sideways like a firearm muzzle brake. That will decrease the air pressure buildup inside the barrel in front of the projectile, and thus should decrease the overall loss of velocity due to air resistance.

In particular, vents can be positioned symmetrically within a ring, to avoid a non-zero net lateral force on the barrel, and then multiple such rings can be positioned as needed along the barrel.

Flip Timing Limitations of Solenoid Geometry

It is clear from the acceleration integral that flipping too early or too late with respect to a particular loop would decrease the final velocity and thus degrade the overall performance of the gun. That is why it would be ideal to have the centers of all loops coincide in a single point, which would also be the point at which the dipole would flip direction. Consequently, that assumption was used in the above basic-concept calculations.

However, the number of loops that can be fitted concentrically with a common center is limited by the size of the individual wire. Furthermore, the formula for the final velocity suggests that the radius R should also be kept as small as possible. Finally, by the same formula, a large N is also beneficial. These requirements are difficult to accommodate in practical solenoids, so some compromise will be required in practical implementations.

One potential partial solution is to realize and utilize the fact that the dipole cannot flip instantaneously. Basically, there will be some distance of travel, over which the dipole will flip direction. During that flip, the magnetic force on the dipole will be significantly reduced by virtue of the dot product between the magnetic dipole and the magnetic field. For example, the force would be zero when the dipole is perpendicular to the x axis. Consequently, if the physical size of the solenoid along the x axis matches the flip region of the dipole, the change in horizontal velocity of the projectile through the solenoid region due to the acceleration from the magnetic force will be minimal.

Practical Implementation Considerations

Sabot Reuse

Magnetic sabots can be a significant expense to the use of a steady-field coilgun of that variety. In essence, they can be thought of as the equivalent of shell casings for a firearm. Just as shell casings can be reloaded, so can magnetic sabots be reused.

One potential implementation would be to position a capturing coil below and in front of the coilgun. The result will be the sabot fragments deflecting downward and being collected neatly. As they are all magnetic and would be oriented accordingly in flight by the capture field, they will in fact increase the capture field as they accumulate in the reclamation area. Reusing the sabots will potentially significantly improve the economics of the discarding-sabot steady-field coilgun.

One potential problem is that rifling may damage the sabots sufficiently, so that reuse would be undesirable or impractical after one use or a small number of reuses. One way to approach this problem is to question if rifling is indeed needed for the sabot coilgun. For example, modern tank cannons are often smoothbores anyway.

AC vs DC and Coil Design

Conductors have the property that DC currents travel through the entire cross-section of the wire, while AC currents are mainly confined to the skin depth of the material. For metals at typical AC frequencies, the skin depth is a few millimeters, which is why high-AC-current cables are built as arrays of a large number of smaller individually insulated wires. This makes for expensive bulky heavy cables.

The steady-field coilgun therefore has the advantage that since the current in the coil is essentially a DC current, the architecture of the coil can be significantly simplified. That would decrease complexity and should lower costs by a large margin.

Use of Superconductors

The steady-field coilgun solve the problem of energy waste in setting up and taking down magnetic fields in a traditional coilgun. However, the fact remains that the muzzle velocity will still be determined by the field strength and thus the electrical current magnitude inside the coils. Running current will generate Joule heating, which is energetically wasteful.

One potential solution is to use superconductor material for the wiring of the coil and keep the coil at the appropriate temperature for superconductivity, e.g., the boiling point of liquid nitrogen. The benefit is that superconductivity would mean the resistance in the circuit goes to zero, so Joule heating will be avoided. That makes the coilgun efficient, but it requires using specific materials and continuous cooling to maintain the coil at appropriate temperature.

It should be noted that the above is doable as the barrel itself does not need to be in mechanical contact with the accelerator coil. An airgap between the barrel and the coil shroud may be sufficient to ensure that each is maintained at appropriate temperature without too much difficulty. After the initial cooling, the heating inside the coil shroud should come externally, as the electrical resistance inside the coil would be zero.

The cooling requirements will prevent the use of superconductors in hand-held and possibly small-vehicle formats. However, it should not be a big challenge to set up such a system on a ship, where there would be sufficient space for it. Then, multiple potential applications come to mind.

A ship-based small-caliber rapid-firing version could provide a large volume of fire for point defense applications. As drones and fleets of drones become more widely used, the need for such a system will only increase. While there are missile-based defense systems, there also are growing concerns that the missile could be more expensive than the drone, making missile-based defense an economically losing proposition. An alternative solution would be laser systems, but they need dwell time to be effective, are limited by atmospheric factors, and may not have the power density needed to engage enough targets fast enough. There is a growing concern that an effective drone strategy would be to overwhelm quality-based defenses by sheer quantity.

In contrast, a steady-field coilgun is primarily limited by the rate at which the ammunition can be fed to the barrel, which in reality can be quite high. Hence, a steady-field coilgun can in principle output a very high rate of fire with abundant and inexpensive ammunition. There can be some time limitations with the flip approaches, but they should be optimizable. Also, the curb flip approach can lead to barrel heating due to the mechanical impact on the curb. Barrel cooling by proximity to the superconductor shroud can help but may still be a limitation. Still, overall, a small-caliber rapid-firing steady-field coilgun is a very promising solution to the point-defense problem on ships.

As an alternative approach, a medium-caliber version is also feasible, wherein the payload can have a conventional fragmentation warhead, e.g., similar to anti-aircraft shells. The principle of operation is to produce a cloud of shrapnel, as an area-effect weapon, so a single round can destroy or disable multiple drone targets in the same area of effect. The number of rounds needed per unit volume of engagement space is then significantly lowered, while the effect scales favorably with the number of targets. In comparison with firearm versions, a steady-field coilgun should be able to fire larger shells faster, thereby producing a more effective and denser area saturation.

Using superconductors is particularly attractive in space since the cooling down to superconductivity temperatures is already accomplished by being in space. This makes coilguns and rail guns the weapon of choice in space battles, particularly at shorter ranges and for point defense.

Disclosed herein are example embodiments including, but not limited to the following:

[A1] A method for operating an electromagnetic coilgun system, the electromagnetic coilgun system including a barrel and a longitudinally extending electrical excitation coil, the electrical excitation coil including a first portion arranged circumferentially around a muzzle end of a bore of the barrel and a second portion arranged circumferentially around a discharge region protruding beyond the muzzle end of the bore, the method comprising: energizing the electrical excitation coil to produce a steady-state magnetic field within and around the muzzle end of the bore of the barrel, the steady-state magnetic field extending along a longitudinal axis of the barrel and longitudinally beyond the muzzle end of the barrel; loading the barrel with a magnetic sabot at a breech end of the barrel, the magnetic sabot housing a nonmagnetic projectile; and firing the magnetic sabot and housed nonmagnetic projectile by magnetically propelling the magnetic sabot, with the housed nonmagnetic projectile, along the longitudinal axis of the bore by a magnetic force produced by the steady-state magnetic field within and around the bore of the barrel, wherein the magnetic sabot is shed from the nonmagnetic projectile as the magnetic sabot and nonmagnetic projectile are launched from the muzzle end of the bore.

[A2] The method of paragraph [A1], wherein the magnetic sabot includes multiple sections which open up and release the nonmagnetic projectile as it exits the muzzle end of the bore.

[A3] The method of paragraph [A1], wherein all or a portion of the magnetic sabot is collected for reuse by gravity and/or by an additional magnetic field oriented perpendicular to the barrel and concentrated in front of the muzzle end of the bore.

[A4] The method of paragraph [A1], wherein the barrel bore is smooth to minimize deceleration of the magnetic sabot from friction and thus maximize muzzle velocity.

[A5] The method of paragraph [A1], wherein the barrel bore is rifled to impart rotation on the nonmagnetic projectile for gyroscopic stabilization of the nonmagnetic projectile in flight after exiting the muzzle end.

[A6] The method of paragraph [A1], wherein the electromagnetic gun system is used for ship point-defense, vehicle point-defense, building point-defense, anti-aircraft, anti-drone, and/or area effect or area saturation or suppressive fire.

[B1] An electromagnetic coilgun system comprising: a barrel including a longitudinally extended bore, a breech end and a muzzle end; a longitudinally extended electrical excitation coil including a first portion arranged circumferentially around the muzzle end of the bore of the barrel and a second portion arranged circumferentially around a discharge region protruding beyond the muzzle end of the bore; wherein a) energizing the electrical excitation coil produces a steady-state magnetic field within and around the muzzle end of the bore of the barrel, the steady-state magnetic field extending along a longitudinal axis of the barrel and longitudinally beyond the muzzle end of the barrel, b) a magnetic sabot housing a nonmagnetic projectile is loaded at the breech end of the barrel, c) the magnetic sabot and housed nonmagnetic projectile are fired by magnetically propelling the magnetic sabot, and housed nonmagnetic projectile, along the longitudinal axis of the bore by a magnetic force produced by the steady-state magnetic field within and around the bore of the barrel, and d) the magnetic sabot is shed from the nonmagnetic projectile as the magnetic sabot and nonmagnetic projectile are launched from the muzzle end of the bore.

[B2] The system of paragraph [B1], wherein the sabot includes multiple sections which open up and release the nonmagnetic projectile.

[B3] The system of paragraph [B1], wherein all or a portion of the magnetic sabot is collected for reuse by gravity and/or by an additional magnetic field oriented perpendicular to the barrel and concentrated in front of the muzzle end of the bore.

[B4] The system of paragraph [B1], wherein the barrel bore is smooth. to minimize deceleration of the magnetic sabot from friction and thus maximize muzzle velocity.

[B5] The system of paragraph [B1], wherein the barrel bore is rifled to impart rotation on the nonmagnetic projectile for gyroscopic stabilization of the nonmagnetic projectile in flight after leaving the muzzle end.

[B6] The system of paragraph [B1], wherein the electromagnetic gun system is used for ship point-defense, vehicle point-defense, building point-defense, anti-aircraft, anti-drone, and/or area effect or area saturation or suppressive fire.

[C1] A method for operating an electromagnetic coilgun system, the electromagnetic coilgun system including a barrel and a longitudinally extended electrical excitation coil arranged circumferentially around a bore of the barrel, the method comprising: energizing the electrical excitation coil to produce a steady-state magnetic field within and around the bore of the barrel, the steady-state magnetic field extending along a longitudinal axis of the barrel; loading the barrel with a magnetic dipole projectile at a breech end of the barrel, the loaded magnetic dipole projectile oriented with a first magnetic dipole moment aligned to a magnetic field orientation of the steady state magnetic field; and firing the magnetic dipole projectile by magnetically propelling the magnetic dipole along the longitudinal axis of the bore by a magnetic force produced by the steady-state magnetic field within and around the bore of the barrel; wherein, at or near a center of the electrical excitation coil, the magnetic dipole moment of the magnetic dipole projectile is flipped to be oriented to a second magnetic dipole moment, 180 degrees opposite to the first magnetic dipole moment and opposite to the magnetic field orientation of the steady state magnetic field, and the magnetic dipole projectile travels continuously from the breech end of the barrel, through the electrical excitation coil and is launched from the muzzle end of the bore of the barrel.

[C2] The method of paragraph [C1], wherein the magnetic dipole projectile includes a permanent magnet made of a ferromagnetic material including iron, cobalt, nickel, Alnico, ferrite, or a rare-earth material including neodymium or samarium-cobalt.

[C3] The method of paragraph [C1], wherein the magnetic dipole flip is caused by a curb inside the barrel which applies a torque onto the magnetic dipole projectile to produce a rotation for the flip.

[C4] The method of paragraph [C3], wherein the barrel bore is smooth before a center of the electrical excitation coil but is rifled or partially rifled in a region of the barrel bore after the magnetic dipole is flipped.

[C5] The method of paragraph [C1], wherein a plurality of electrical excitation coil stages are used for acceleration of the magnetic dipole projectile and are positioned at different longitudinal locations along the barrel, the output of each stage the input to the next stage, except for the last stage, whose output is the muzzle end of the barrel.

[C6] The method of paragraph [C5], wherein a magnetic field of a next stage is opposite to a magnetic field of a previous stage, so that a flipped magnetic dipole projectile emerging from the previous stage has a dipole moment in the same direction as the magnetic field of the next stage to accelerate the magnetic dipole projectile into the electrical excitation coil of the next stage.

[C7] The method of paragraph [C5], wherein a magnetic field of a next stage is aligned to the magnetic field of a previous stages, so that a twice flipped magnetic dipole projectile emerging from the previous stage has its dipole moment in the same direction as the magnetic field of the next stage to accelerate the magnetic dipole projectile into the electrical excitation coil of the next stage.

[C8] The method of paragraph [C5], wherein the barrel bore is smooth everywhere except in an initial section of a first stage of the barrel bore nearest the breech end of the barrel to impart an initial rotation for the instability effect.

[C9] The method of paragraph [C1], wherein the magnetic dipole projectile has three different principal moments of inertia and is magnetized with a dipole moment pointing along its intermediate axis.

[C10] The method of paragraph [C1], wherein the magnetic dipole projectile is in the shape of a rectangular prism of dimensions a, b and c, where a>b>c, and the magnetic dipole projectile is magnetized in a direction of an intermediate principal axis.

[C11] The method of paragraph [C10], wherein an initial rotation around an intermediate axis is brought about by rifling inside the initial section of the barrel, in combination with an acceleration from the magnetic force on the magnetic dipole projection from the electrical excitation coil.

[C12] The method of paragraph [C1], wherein the barrel is slotted along a longitudinal length to disallow a formation of circular eddy currents by an electromotive force induced by a varying magnetic flux generated by a motion of the magnetic dipole projectile inside the barrel bore.

[C13] The method of paragraph [C1], wherein the slotted barrel is also used as a means of venting air in lateral directions, to decrease air pressure buildup in front of the magnetic dipole projectile and thus decrease an overall deceleration due to air resistance.

[C14] The method of paragraph [C1], wherein multiple magnetic dipole projectiles are accelerated through the barrel at the same time, resulting in an increased rate of fire.

[D1] An electromagnetic coilgun system comprising: a barrel including a longitudinally extended bore, a breech end and a muzzle end; a longitudinally extended electrical excitation coil arranged circumferentially around the bore of the barrel; and a magnetic dipole moment flipper located at or near a center of the electrical excitation coil, the magnetic dipole moment flipper reversing a dipole moment of a magnetic dipole projector traveling from the breech end of the barrel within the steady state magnetic field nearest the breech end of the barrel, the loaded magnetic dipole projectile oriented with a first magnetic dipole moment aligned to a magnetic field orientation of the steady state magnetic field, and the magnetic dipole projectile propelled along the longitudinal axis of the bore by a magnetic force produced by the steady-state magnetic field within and around the bore of the barrel.

[D2] The system of paragraph [D1], wherein the magnetic dipole projectile includes a permanent magnet made of a ferromagnetic material including iron, cobalt, nickel, Alnico, ferrite, or a rare-earth material including neodymium or samarium-cobalt.

[D3] The system of paragraph [D1], wherein the magnetic dipole flip is caused by a curb inside the barrel which applies a torque onto the magnetic dipole projectile to produce a rotation for the flip.

[D4] The system of paragraph [D3], wherein the barrel bore is smooth before a center of the coil but is rifled or partially rifled in a region of the barrel bore after the magnetic dipole is flipped.

[D5] The system of paragraph [D1], wherein a plurality of electrical excitation coil stages are used for acceleration of the magnetic dipole projectile and are positioned at different longitudinal locations along the barrel, the output of each stage the input to the next stage, except for the last stage, whose output is the muzzle end of the barrel.

[D6] The system of paragraph [D5], wherein a magnetic field of a next stage is opposite to a magnetic field of a previous stage, so that a flipped magnetic dipole projectile emerging from the previous stage has a dipole moment in the same direction as the magnetic field of the next stage to accelerate the magnetic dipole projectile into the electrical excitation coil of the next stage.

[D7] The system of paragraph [D6], wherein a magnetic field of a next stage is aligned to the magnetic field of a previous stages, so that a twice flipped magnetic dipole projectile emerging from the previous stage has its dipole moment in the same direction as the magnetic field of the next stage to accelerate the magnetic dipole projectile into the electrical excitation coil of the next stage.

[D8] The system of paragraph [D6], wherein the barrel bore is smooth everywhere except in an initial section of a first stage of the barrel bore nearest the breech end of the barrel to impart the initial rotation for the instability effect.

[D9] The system of paragraph [D1], wherein the magnetic dipole projectile has three different principal moments of inertia and is magnetized with a dipole moment pointing along its intermediate axis.

[D10] The system of paragraph [D1], wherein the magnetic dipole projectile is in the shape of a rectangular prism of dimensions a, b, and c, where a>b>c, and the magnetic dipole projectile is magnetized in a direction of an intermediate principal axis.

[D11] The system of paragraph [D10], wherein an initial rotation around an intermediate axis is brought about by rifling inside the initial section of the barrel, in combination with an acceleration from the magnetic force on the magnetic dipole projection from the electrical excitation coil.

[D12] The system of paragraph [D1], wherein the barrel is slotted along a longitudinal length to disallow a formation of circular eddy currents by an electromotive force induced by a varying magnetic flux generated by a motion of the magnetic dipole projectile inside the barrel bore.

[D13] The system of paragraph [D1], wherein the slotted barrel is also used as a means of venting air in lateral directions, to decrease air pressure buildup in front of the magnetic dipole projectile and thus decrease an overall deceleration due to air resistance.

[D14] The system of paragraph [D1], wherein multiple magnetic dipole projectiles are accelerated through the barrel at the same time, resulting in an increased rate of fire.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMS, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. An electromagnetic coilgun system comprising:

a barrel comprising a longitudinally extended bore, a breech end and a muzzle end;

wherein an electrical excitation coil circumferentially surrounds the longitudinally extended bore of the barrel; and a magnetic dipole moment flipper located near a center of the electrical excitation coil, wherein the magnetic dipole moment flipper is configured to reverse a dipole moment of a magnetic dipole projectile traveling from the breech end of the barrel within a steady state magnetic field nearest the breech end of the barrel;

wherein the loaded magnetic dipole projectile is oriented in the breech with a first magnetic dipole moment aligned to a magnetic field orientation of the steady state magnetic field.

2. The system of claim 1, wherein the magnetic dipole projectile comprises a ferromagnetic material selected the group consisting of: iron, cobalt, nickel, Alnico, ferrite, rare-earth material, and combinations thereof.

3. The system of claim 1, wherein a magnetic dipole flip is caused by a curb inside the barrel which applies a torque onto the magnetic dipole projectile to produce a rotation for the flip.

4. The system of claim 3, wherein the barrel bore is smooth before a center of the coil and is rifled or partially rifled in a region of the barrel bore after the magnetic dipole flip.

5. The system of claim 1, wherein a plurality of electrical excitation coil stages are used for acceleration of the magnetic dipole projectile and are positioned at different longitudinal locations along the barrel, the output of each stage the input to the next stage, except for the last stage, whose output is the muzzle end of the barrel.

6. The system of claim 5, wherein a magnetic field of a next stage is opposite to a magnetic field of a previous stage, so that a flipped magnetic dipole projectile emerging from the previous stage has a dipole moment in the same direction as the magnetic field of the next stage to accelerate the magnetic dipole projectile into the electrical excitation coil of the next stage.

7. The system of claim 5, wherein a magnetic field of a next stage is aligned to the magnetic field of a previous stages, so that a twice flipped magnetic dipole projectile emerging from the previous stage has its dipole moment in the same direction as the magnetic field of the next stage to accelerate the magnetic dipole projectile into the electrical excitation coil of the next stage.

8. The system of claim 5, wherein the barrel bore is smooth everywhere except in an initial section of a first stage of the barrel bore nearest the breech end of the barrel to impart the initial rotation for the instability effect.

9. The system of claim 1, wherein the magnetic dipole projectile has three different principal moments of inertia and is magnetized with a dipole moment pointing along its intermediate axis.

10. The system of claim 1, wherein the magnetic dipole projectile is in the shape of a rectangular prism of dimensions a, b and c, where a>b>c, and the magnetic dipole projectile is magnetized in a direction of an intermediate principal axis.

11. The system of claim 10, wherein an initial rotation around an intermediate axis is brought about by rifling inside the initial section of the barrel, in combination with an acceleration from the magnetic force on the magnetic dipole projection from the electrical excitation coil.

12. The system of claim 1, wherein the barrel is slotted along a longitudinal length; and wherein the slots are configured to prevent circular eddy currents by varying the magnetic flux.

13. The system of claim 1, wherein the slotted barrel is configured to vent gases laterally from the muzzle of the barrel.

14. The system of claim 1, wherein a firing rate is increased by consecutively accelerating a plurality of magnetic dipole projectiles through the barrel.

* * * * *